US006021901A

United States Patent [19]

Wolfe

[11] Patent Number: 6,021,901

[45] Date of Patent: Feb. 8, 2000

[54] CHILD-RESISTANT CONTAINER

[75] Inventor: Steven R. Wolfe, Maumee, Ohio

[73] Assignee: Owens-Illinois Closure Inc., Toledo, Ohio

[21] Appl. No.: 09/157,532

[22] Filed: Sep. 21, 1998

[51] Int. Cl.[7] ..... B65D 83/04

[52] U.S. Cl. ..... 206/531; 206/1.5; 220/326

[58] Field of Search ..... 206/528, 531, 206/532, 533, 535–540, 105, 807; 220/836–839, 326, 324; 215/224

[56] References Cited

U.S. PATENT DOCUMENTS

| | | | |
|---|---|---|---|
| 3,616,487 | 11/1971 | Dearth | 220/839 |
| 3,630,171 | 12/1971 | Huck | 206/539 |
| 4,219,116 | 8/1980 | Borkan . | |
| 4,392,503 | 7/1983 | Watanabe . | |
| 4,401,210 | 8/1983 | Anjou . | |
| 4,561,544 | 12/1985 | Reeve . | |
| 4,746,008 | 5/1988 | Heverly et al. | 220/837 |
| 4,890,742 | 1/1990 | Allison . | |
| 4,998,623 | 3/1991 | Doull | 206/539 |
| 5,080,222 | 1/1992 | McNary . | |
| 5,082,113 | 1/1992 | Romick | 206/539 |
| 5,267,650 | 12/1993 | Gilbilisco . | |
| 5,275,291 | 1/1994 | Sledge . | |
| 5,346,069 | 9/1994 | Intini . | |
| 5,441,150 | 8/1995 | Ma | 220/839 |
| 5,575,399 | 11/1996 | Intini . | |
| 5,645,167 | 7/1997 | Conrad | 206/1.5 |
| 5,695,063 | 12/1997 | Roulin . | |
| 5,740,938 | 4/1998 | Hofmann . | |
| 5,788,105 | 8/1998 | Foos | 206/1.5 |

*Primary Examiner*—Paul T. Sewell
*Assistant Examiner*—Luan K. Bui

[57] ABSTRACT

A child-resistant compact or tablet case of one-piece molded plastic construction made up of a generally flat rectangular base and a cover top interconnected by an integral "living" hinge. A pair of mating lip flanges extend one each along the front edges of the base and top, i.e., the edges remote from the hinge. Each flange has an arcuate recess, and these recesses are mutually offset from each other laterally of the case when it is closed with the flanges lying against one another. By placing a thumb in one recess, and the tip of the forefinger in the other recess, a pry-open force may be applied to thus readily open the case. Since only one recess is visible when viewing the case from the top or the bottom, this manner of opening the case is not readily apparent to an infant or young child, but is very easy for an infirm or elderly adult to comprehend and use for opening the compact case merely by finger feel. In addition, the base has a pair of latch spring fingers disposed one on each of the laterally opposed sides near the front edge of the base and that protrude upwardly from the base bottom wall in cantilever fashion. The top has a cooperating pair of pockets that receive the free latch-tang ends of the spring fingers to render them exterior-accessible in the closed condition of the case. The outer edges of these pockets form the strike portion of the latch system. To open the case, squeeze pressure must be applied with one hand simultaneously to both of the spring finger tang ends to move them to unlatched condition, and then to hold them in this condition while, also simultaneously, with the other hand pry-open pressure is applied to the two front lip flanges at the aforementioned offset recesses. This two-handed operation further resists opening by a child because of its complex dual-hand-manipulative coordination requirement.

8 Claims, 2 Drawing Sheets

CHILD-RESISTANT CONTAINER

FIELD OF THE INVENTION

This invention relates to hand-held type containers or boxes used for storing articles, and more particularly, to a child-resistant compact or a tablet case for storing items such as blister-pack medicine tablet packages.

BACKGROUND OF THE INVENTION

The use of child-resistant packaging is well-known in the art and utilized for many different types of goods. Such packaging is used primarily for those products which present a potential hazard in the hands of children—i.e., medicaments, and the like, as well as potentially less dangerous but troublesome contents, such as cosmetic compact ingredients. Many pharmaceutical products are packaged in the form of pills or tablets sealed in blister packages. A container for storage and dispensing of tablets from a blister pack should have a low aspect ratio, typically a rectangular outline and generally, for convenience, be of a hand-held size. The same is true if the container is to be used as a cosmetic compact case.

In designing child-resistant packages, it is also important that the package can be opened without undue difficulty by the average consumer for whom the product is intended, and particularly for the elderly. Thus packaging which relies on a certain amount of strength to open is often self-defeating in that the interested end user may find it difficult or impossible to open such packaging. Additionally the elderly often find it difficult to open blister packages to access tablets encased therein. Accordingly, such containers and dispensers for tablets may have the floor of the container apertured, and the container designed to receive a multi-blister pill pack with the blisters in registry with the apertures. This enables dispensing of individual tablets from their individual blisterpack compartments by push down from above to thereby rupture the thin barrier film provided on the underside of the blister pack and thus expel the tablet through the associated bottom wall hole of the container. The base of the container thus has a plurality of holes which conform to the spacing and size of the individual blister-pack and blister-pack compartments.

Typically, such containers are designed with a base and a cover connected thereto along one edge by a hinge structure, and are further provided with closure systems in which various of types of latches that require the application of predetermined forces by using the fingers of two hands, either simultaneously or successively in a coordinated manner, thereby making the container difficult to open by children. Examples of such structures in the prior art are found in U.S. Pat. Nos. 4,219,116; 5,275,291; 5,346,069; and 5,740,938, as well as in many of the references cited as prior art therein.

OBJECTS OF THE INVENTION

Accordingly, it is an object of the present invention to provide an improved child-resistant container for use as a compact or tablet case, and improved method of storing and dispensing a number of different items, in such a container or package wherein a substantial amount of strength is not required to open the package and yet an improved child-resistant closure feature is provided.

Another object is to provide an improved child-resistant container of the aforementioned character which is simple in construction and design and thus readily adaptable for injection molding of plastic material as a one-piece product, that is readily adaptable to being made as a self-dispensing package for a pharmaceutical product packaged in blister packs, and wherein, if desired, only two releasable locking latches need be provided in the container construction and yet the container cannot be readily opened unless the fingers of both hands are simultaneously utilized to operate the latches and pry open the package.

SUMMARY OF THE INVENTION

In general, and by way of summary description and not by way of limitation, the invention achieves the foregoing and other objects by providing, in a preferred embodiment an improved child-resistant container in the form of a compact case or tablet case of one-piece molded plastic construction made up of a generally flat rectangular base and a cover top interconnected by an integral "living" hinge. The base and the top each have a lip flange that extends at least along the front edge of the base and top, i.e., the edge remote from the hinge. Each flange has an arcuate recess, and these recesses are mutually offset from each other when the case is closed with the flanges lying against one another. Accordingly, a thumb may be placed in the recess of the cover top flange, and the tip of the forefinger in the recess of the base flange, and then oppositely manipulated to apply a pry-open force to the flanges and thus readily open the compact. However, due to the offset of the flanges relative to one another, only one or the other of the recesses is visible when viewing the case from the top or the bottom sides. Hence, this manner of opening the case is not readily apparent to an infant or young child, but is very easy for an infirm or elderly adult to comprehend and use for opening the compact case merely by finger feel.

In addition, the base has a pair of spring fingers disposed on laterally opposed sides near the front edge of the base, that align laterally with each other. These fingers protrude upwardly from the bottom wall of the base in cantilever fashion so that their upper ends are formed as latch tangs and terminate generally flush with the outer top wall of the cover top. The top has a cooperating pair of pockets that receive the tang ends of the spring fingers in the closed condition of the case. The outer edges of these pockets form the strike portion of a latch system. The inner edges of these pockets are spaced a given distance from the strike so as to permit only sufficient swinging motion of the free end of the fingers to enable unlatching of the finger tang from the strike portion of the associated top opening.

To open the case, squeeze pressure must be applied with one hand simultaneously to both of the spring fingers to move them to unlatched condition, and then to hold them in this condition while, also simultaneously, with the other hand pryopen pressure is applied to the two front lip flanges at the aforementioned offset recesses. This two-handed operation resists opening by a child because of its complex coordination requirement.

In addition, preferably the two spring fingers are spaced apart by a distance of at least three to four inches so as to exceed the normal span between the thumb and middle finger of an infant. The protrusion of the free end of the spring finger flush with the top cover also serves as a barrier to prevent lifting the cover by using a fingernail to grip the inward most edge of pocket openings in the cover top.

Preferably, a tablet case in accordance with the preferred embodiment lends itself to being constructed as a blister pack-type dispenser. For this purpose, an array of holes or openings is provided in the base of the case that are sized to conform to the size and spacing of the blister pack compartments that individually contain articles to be dispensed from the blister pack. The case is dimensioned so that insertion of the blister pack retains it in place properly oriented so that when a tablet is to dispensed, the case is opened and pressure is applied to a tablet so as to break the blister pack bottom plastic seal, thereby pushing the tablet through the corresponding case bottom wall opening that registers with such tablet in the blister pack.

If desired, a third latch system can be added to the case lip flanges of a conventional snap-catch type.

BRIEF DESCRIPTION OF THE DRAWINGS

The foregoing, as well as further objects, features and advantages of the present invention will become apparent from the following detailed description of a preferred but exemplary embodiment of the best mode presently contemplated for carrying out the invention, from the appended claims and with reference to the accompanying drawings wherein:

DETAILED DESCRIPTION OF PREFERRED EMBODIMENTS

Figure 1:
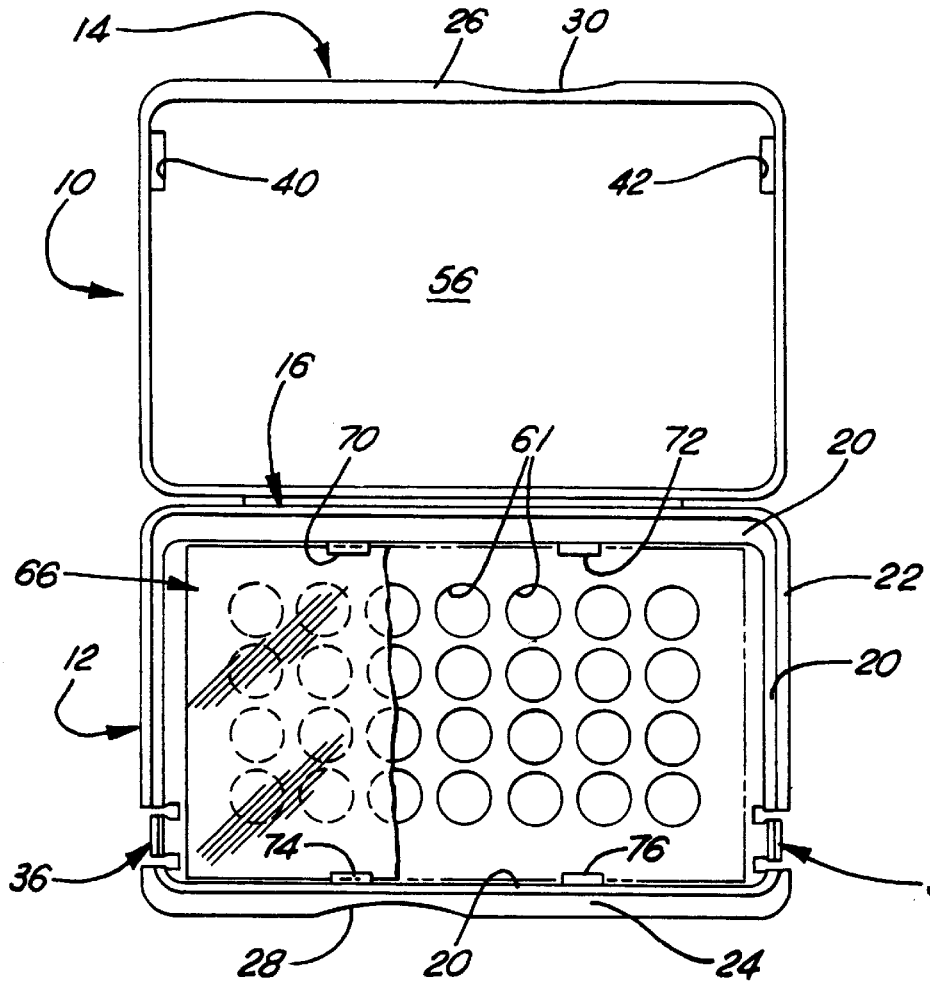
FIG. 1 is a top plan view of a preferred but exemplary embodiment of a child-resistant, blister tablet push-down dispensing-type container of the invention shown with the container cover top swung back to fully open position relative to the container base.
Figure 2:
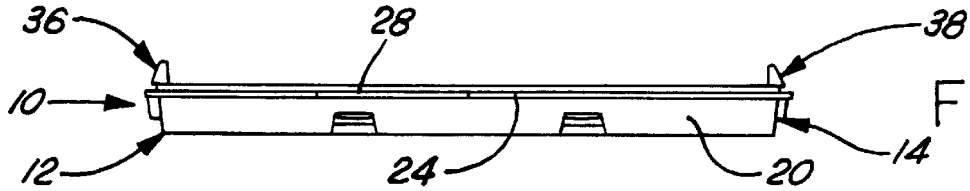
FIG. 2 is a front elevational view of the container as opened in FIG. 1.

Referring now more particularly to the drawings, a preferred but exemplary embodiment of the child-resistant container construction in accordance with the invention is generally designated 10 in FIGS. 1 through 7. Container 10 is preferably sized to be conveniently hand-held and is of one-piece molded plastic construction adapted for mass production utilizing conventional plastic injection molding processes and apparatus. Container 10 includes a base 12 and a top or cover 14 with these two principal components being interconnected by an integral "living" spring hinge 16 designed to normally resiliently bias the cover to the open position of FIG. 1.

As is evident from the views of FIGS. 1 through 5, container 10 is preferably of rectangular outline i plan and elevational views and of relatively shallow depth so as to have a low aspect ratio befitting use as a hand-held type compact or tablet case. Base 12 has a flat bottom wall 18 with a four-sided peripheral wall 20 rising integrally therefrom and terminating on all four sides at a co-planar peripheral upper edge 22.

Figure 3:
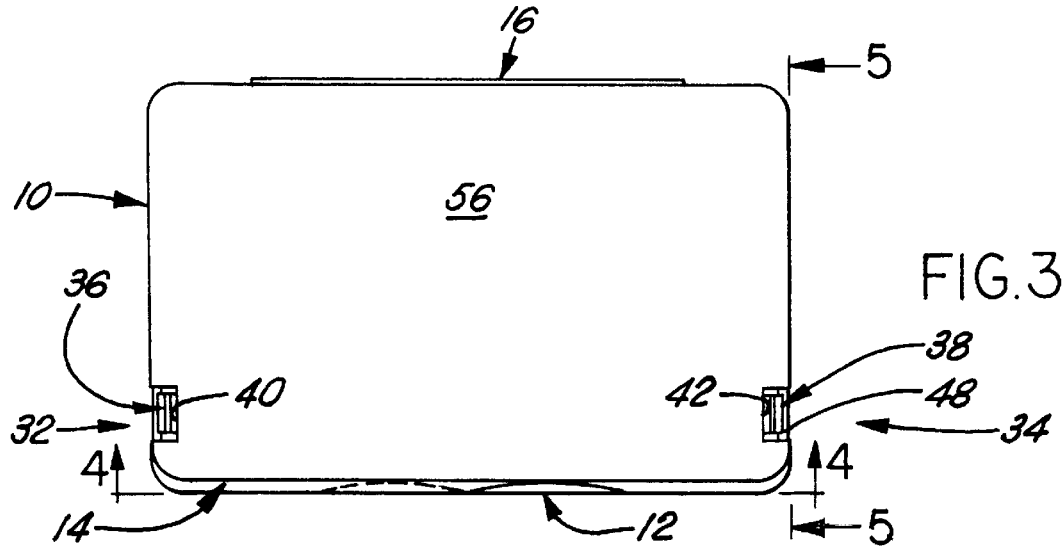
FIG. 3 is a top plan view of the container of FIGS. 1 and 2 with the cover top closed down and latched on the base.
Figure 4:
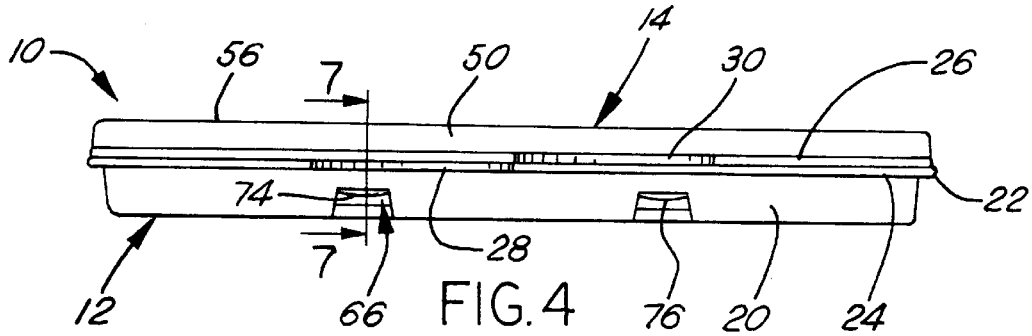
FIG. 4 is a front elevational view of the container in the closed condition of FIG. 3.

In accordance with one feature of the invention, edge 22 is widened along the front edge of base 12 to form a closure flange lip 24. A mating closure flange lip 26 is formed along the front edge of cover 14 that, in the closed condition of the container, is adapted to lie flat against and generally co-extensive with base lip 24. Closure lips 24 and 26 each have an arcuate recess 28 and 30 respectively that are laterally offset completely out of registry from each other when the case or container is closed (FIGS. 3 and 4). Hence, a thumb of a knowledgeable adult may be placed in cover lip recess 30 to bear on base lip 24 while the tip of a forefinger of the same hand may be placed in base lip recess 28 to bear upwardly on cover lip 26 to thereby readily pry the compact 10 open. Nevertheless, cover lip 26 conceals recess 28 in base lip 24 when container 10 is closed when generally viewed from above, and vice versa.

Figure 5:
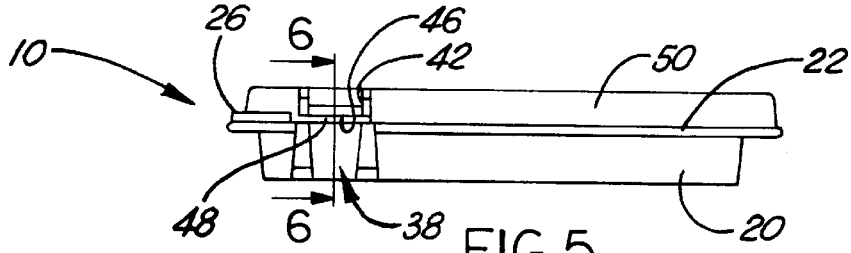
FIG. 5 is an end elevational view of the container in the closed condition of FIGS. 3 and 4.
Figure 6:
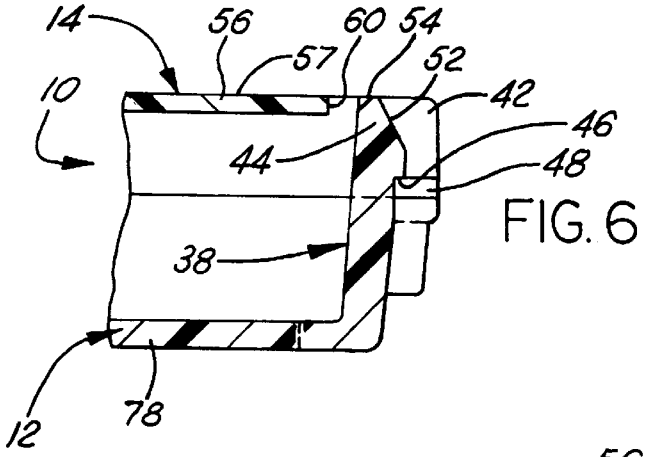
FIGS. 6 and 7 are fragmentary cross-sectional view taken respectively on the lines 6—6 of FIGS. 5 and 7—7 of FIG. 4.

Cover 14 is releasably but securely held closed against base 12 by a pair of latches 32 and 34 disposed one on each of the laterally opposed sides of container 10. Each latch 32,34 comprises a latch spring finger and cooperative catch strike oriented to align with each other in the closed condition of the container. As best seen in FIGS. 1, 5 and 6, each latch 32 and 34 thus comprises a spring finger 36 and 38 respectively that is integrally formed (i.e., molded in one piece) with base 12. Each latch 32 and 34 also includes a cooperative pocket opening 40 and 42 respectively suitably formed in cover 14 such that the tang end 44 of each spring finger 36, 38 protrudes into opening 40,42 in the closed position of the container (FIGS. 3, 5 and 6). Spring fingers 36 and 38 are integrally cantilevered from base bottom wall 18, are resilient and designed so as to be slightly stressed when the fluke edge 46 (FIG. 6) of each finger tang 44 latches over a cooperative latch strike portion 48 of the peripheral side wall 50 of cover 14 that strike portion 48 spanning across the associated pocket opening 40, 42 as best seen in FIGS. 3, 5 and 6. The outwardly facing edge surface 52 (FIG. 6) of each finger tang 44 is angled to provide a camming action for deflecting the associated spring finger inwardly as the cover 14 is being fully closed and the catch strike 48 is thus riding down the tang surface 52.

Preferably, the upper edge 54 of each finger tang 44 is dimensioned so as to be oriented substantially flush with the upper outer surface 57 (FIG. 6) of the flat top wall 56 of cover 14 in the latched-closed condition of container 10. When so constructed and oriented, tang 44 provides a barrier obstruction to the top inwardmost edge 60 of each wall pocket opening 40, 42, when latch spring finger 36,38 is swung clear of strike 48, that prevents a finger tip from gripping edge 60 and attempting to thereby pry cover 14 open. Also, for this purpose each edge 60 is offset (as viewed in the plane of FIG. 6 of the drawings) from the inner edge of the associated strike 48 a distance only sufficient to provide just enough swing room for the tang end 44 of each spring finger to enable operable latching and unlatching motion thereof.

In accordance with another feature of the present invention, to open cover 14 when in its latched-closed position it is necessary to (1) apply inward pressure to both of the spring fingers 36 and 38 to flex them toward one another for both to clear their respective catch strikes 48, and (2) simultaneously apply the opposed pry-open pressure to lips 24 and 26. That is, a thumb and typically middle finger of one hand would be utilized to bear respectively against and squeeze toward one another the upper tang portions 44 of spring fingers 36 and 38, while the thumb and index finger of the other hand must be simultaneously respectively inserted into the recesses 30 and 28 of the lips 26 and 24 to apply opposed pry-apart pressure on these lips.

It is also necessary to hold the latch spring finger tang catch edge 46 clear of the associated striker portion 48 until cover 14 has been pried open sufficiently to clear the catch edge 46 of the spring finger. Otherwise, if the squeeze pressure on the spring fingers is released prematurely, top 14 will remain latched closed. On the other hand, if the spring fingers 36 and 38 are not squeezed towards one another when pry-open forces are being applied to the lips 24 and 26, the container also cannot be opened because of the latched engagement of the spring fingers individually with their associated catch striker.

It will be seen that the above sequence and manipulation container-opening procedure requires a particular two-handed operation which strongly resists opening by an infant or young child.

The preferred orientation of the upper edge 54 of each spring finger protruding at least flush with the top surface 57 of cover wall 56 also further ensures that cover 14 cannot be lifted by using finger tips to grip the edges 60 of the openings 40 and 42 after squeezing the fingers towards one another to unlatched condition, while the other hand is kept free of the container, i.e., a one-handed opening operation also being thus greatly hindered.

It will also be understood that container 10 is preferably dimensioned such that spring fingers 36 and 38 are spaced apart a distance sufficient (preferably on the order of 3 or more inches, e.g., 3.60 inches approximately in the illustrated embodiment) so that the space therebetween exceeds the maximum obtainable span between the thumb and the longest finger of at least most infants and toddlers. This further disables opening by an infant to thus add to the child-resistant character of container 10.

In the unlikely event that such a child would use one hand to flex one spring finger inward, and the other hand to simultaneously flex the other finger inward, this would leave neither hand available to apply the pry-opening action along the front lips 26 and 24.

As a further embodiment, a conventional snap latch is included (not shown) that can be located on the front of the container as a third latch so as to further latch cover 14 to base 12, and to thus work together as a system with the squeeze latches 32 and 34 at the sides of the container. The snap tab and socket lock can be located on the upper or lower body lips respectively, or vice versa. Such a third lip latch system is thus operable to forestall opening of compact 10 in the event of simultaneous release of both latches 36 and 38 by using the thumb and forefinger of each hand because of the further latching together of lips 24 and 26 by the such a conventional third snap latch construction. With this additional latch provided along the front edge of the compact, the front edge cannot be pried opened because both hands in this unlikely situation would be simultaneously occupied in un-latching the fingers of both latches 36 and 38 coupled with an attempt to lift cover 14 open at these side locations.

Such a protrusion on one of the lips and a snap-in receptacle or recess on the other lip positioned to snap-fit together can be located laterally centered between recesses 28 and 30. Such a snap tab and socket lock construction is shown, for example, in U.S. Pat. No. 4,219,116, the same being incorporated herein by reference in its entirety.

Figure 7:
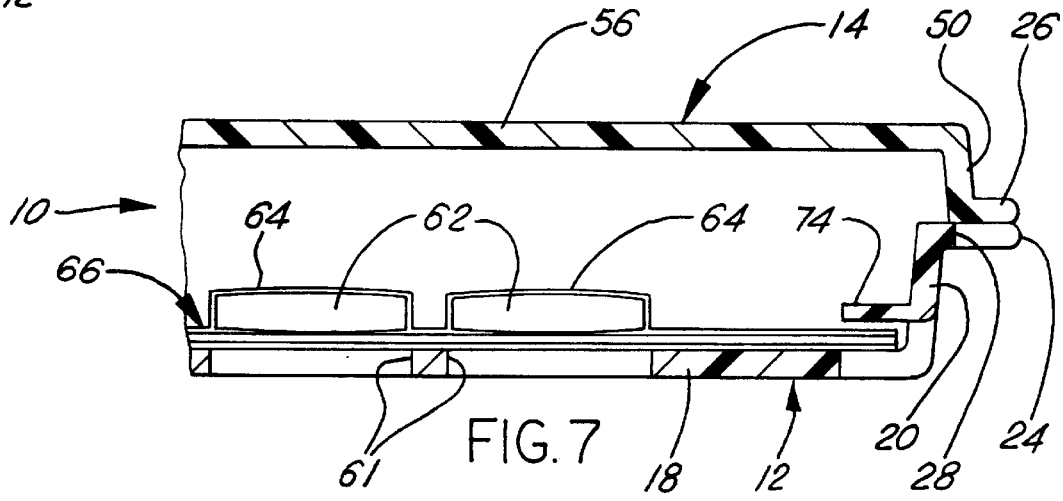

As best seen in FIGS. 1 and 7, container 10 is well-adapted for use in storing a blister pack of tablets to be dispensed through registering openings provided in the bottom wall of the container base 12. Thus, a predetermined plurality of holes or openings 61 may be provided in a pattern array, such as shown in FIG. 1, in bottom wall 18 of base 12 designed to register individually with tablets 62 (FIG. 7) individually contained within associated blister pack compartments 64 of a typical blister pack 66. The blister pack of tablets 66 to be dispensed may be placed flat within base 12 and retained therein by four tabs 70, 72, 74 and 76 (FIGS. 1 and 7). When a tablet 62 is to be dispensed, compact 10 is opened and pressure is applied to a tablet from above so as to break open the bottom liner sheet of the blister pack construction to thereby enable a tablet to be pushed through the associated bottom wall opening 61 that registers with that particular tablet in the blister pack.

It will be seen from the foregoing description that all of the structural features of container 10 are adapted to be economically mass produced by conventional injection molding processes wherein the entire container 10 is integrally formed, i.e., made in one-piece during the molding process, from suitable thermoplastic material. In addition, the container according to the present invention has the advantage of being child-resistant while, nevertheless, it can be readily opened by an adult, even by an elderly and/or infirm adult.

A further advantage of containers incorporating the principles of this invention is that the intended adult users of the container can gain access conveniently and without frustration. The locks or latches 32 and 34 of the container do not require a great deal of strength or dexterity to be activated because this child-resistant feature depends on simultaneous activation of the latches rather than resisting the force of a child's prying fingers. In addition, the pry-open recesses 28 and 30 of the front lips facilitate, for an adult, pry-open action of the container with the thumb and finger of one hand while the two fingers of the other hand are holding the latches 32 and 34 in their release mode. The present invention thus allows access to medication for those most inhibited by lack of strength, dexterity and/or vision from gaining such access.

I claim:

1. A child-resistant container that comprises:

a base having a lip extending along one lateral edge, a cover having a lip extending along one lateral edge, a hinge integrally joining said cover to said base along lateral edges of said base and cover opposed to said lips, and wherein said cover lip and base lip coextensively abut one another when the base and cover are in the closed position and have outer edges that are generally flush with one another when the base and cover are closed, and wherein said lips have cooperative recesses, one on each side of said lips, that are offset from each other longitudinally of the lips when the base and cover are closed such that said base lip recess gives access to a surface of said cover lip facing said base lip and said cover lip recess gives access to a surface of said base lip facing said cover lip, first and second latch means located one on each of the longitudinally opposite ends of said base and cover, and wherein said base and cover are each of rectangular configuration and generally coextensive with one another when said base and cover are closed together, and wherein said latch means are located adjacent the corners of the container that are closest to the aforesaid lips, and wherein each of said first and second latch means comprises a spring finger integrally joined at one end to said base, and an opening in said cover registering with said spring finger in the closed condition of said container, said spring finger having a tang end protruding upwardly at least generally flush with the outer surface of said cover, each said finger also having a tapered camming edge facing outwardly of the container and a catch edge adapted to cooperate with a strike portion of the cover defining a portion of said opening and operable to be engaged by said catch edge of said finger, said strike portion and an opposed edge of said cover opening being spaced apart only by an amount to permit a sufficient swinging motion of said free end of said finger to enable unlatching of the same from the strike portion of the cover so that said finger tang end is operable to thereby block finger tip access to the opposed edge of the cover opening when said spring finger is swung to unlatching position.

2. The container of claim 1 wherein said lips are additionally provided with snap-open registering third latch means.

3. The container of claim 1 adapted to contain a blister-pack of the type containing a plurality of spaced closed blister-pack compartments, each of said closed blister-pack compartments containing a small article, the blister-pack having a blister-pack bottom surface through which the small article is normally dispensed, the blister-pack bottom surface being positioned when in use in said container on a bottom wall of said base, said container having a plurality of article dispensing holes formed in said bottom wall of said base and being sized to conform to the size and spacing of the blister-pack compartments, whereby, when a portion of a blister-pack bottom surface for one of the blister-pack compartments is article-perforated in order to force the small article through a corresponding article dispensing hole, the small article in the one blister-pack compartment can be thereby dispensed through the corresponding article dispensing hole by applying finger pressure on a top of the one blister-pack compartment.

4. The container of claim 3 wherein said lips are additionally provided with snap-open registering third latch means.

5. A method of storing and containing items in a hand-held type container that renders the items generally inaccessible to children comprising the steps of:

a) providing a base having a lip extending along one lateral edge, b) providing a cover having a lip extending along one lateral edge, c) providing a hinge integrally joining said cover to said base along lateral edges of said base and cover opposed to said lips, d) constructing said lips to coextensively abut one another when the base and cover are closed and to have outer edges that are generally flush with one another when the base and cover are closed, and providing said lips with cooperative recesses, one on each of said lips, that are sized for adult finger tip and thumb tip insertion and are offset from each other longitudinally of the lips when the base and cover are closed, e) providing first and second latch means located one on each of the longitudinally opposite ends of said base and cover, f) constructing the base and cover each of rectangular configuration and generally coextensive with one another when said base and cover are closed together, and locating said first and second latch means adjacent the corners of the container that are closest to the aforesaid lips, and g) providing each of said first and second latch means in the form of a spring finger integrally joined at one end to said base, and providing an opening in said cover registering with said spring finger in the closed condition of said container, the spring finger having a tang end protruding upwardly at least generally flush with the outer surface of the cover and having an edge facing outwardly of the container and a catch edge adapted to cooperate with a strike portion of the cover defining a portion of said opening and operable to be engaged by the catch edge of said finger, the strike portion and an opposed edge of the cover opening being spaced apart only by an amount to permit sufficient swinging motion of said free end of said finger to enable unlatching of the same from the strike portion of the cover so that the finger tang end is operable to thereby block access to the opposed edge of the cover opening when the spring finger is swung to its unlatching position.

6. The method of claim 5 wherein said lips are additionally provided with snap-open registering third latch means.

7. The method of claim 5 comprising the further step of providing said container with a blister-pack housed therein and containing a plurality of spaced closed blister-pack compartments, each of said closed blister-pack compartments containing a small article, providing said blister-pack with a blister-pack bottom surface through which the small article is normally dispensed, positioning said blister-pack bottom surface in the container on a bottom wall of said base, providing a plurality of article dispensing holes in the bottom wall of the base sized to conform to the size and spacing of the blister-pack compartments whereby, when a portion of a blister-pack bottom surface for one of the blister-pack compartments is article-perforated in order to force the small article through a corresponding article dispensing hole the small article in the one blister-pack compartment can be thereby dispensed through the corresponding article dispensing hole by applying finger pressure on a top of the one blister-pack compartment.

8. The method set forth in claim 7 wherein said lips are additionally provided with snap-open registering third latch means.

* * * * *